United States Patent [19]

Schneider

[11] Patent Number: 4,760,965

[45] Date of Patent: Aug. 2, 1988

[54] ATOMIZER FOR ELECTROSTATICALLY COATING OBJECTS

[75] Inventor: Rolf Schneider, Burgstetten, Fed. Rep. of Germany

[73] Assignee: Behr-Industrieanlagen GmbH & Co., Fed. Rep. of Germany

[21] Appl. No.: 12,426

[22] Filed: Feb. 9, 1987

[30] Foreign Application Priority Data

May 16, 1986 [DE] Fed. Rep. of Germany ..... 3616684

[51] Int. Cl.[4] ..... B05B 5/00; B05B 1/28; B05B 3/10

[52] U.S. Cl. ..... 239/701; 239/703; 239/104; 239/224; 239/288.5; 239/296

[58] Field of Search ..... 239/104, 105, 223, 224, 239/288-288.5, 290, 296, 699-703

[56] References Cited

U.S. PATENT DOCUMENTS

| | | | |
|---|---|---|---|
| 2,047,699 | 7/1936 | MacLachlan | 239/223 X |
| 3,178,114 | 4/1965 | Point | 239/703 |
| 4,402,991 | 9/1983 | Meisner | 239/703 X |

FOREIGN PATENT DOCUMENTS

| | | | |
|---|---|---|---|
| 2336183 | 8/1977 | France | 239/703 |
| 606020 | 6/1960 | Italy | 239/223 |
| 2166670 | 5/1986 | United Kingdom | 239/701 |

*Primary Examiner*—Andres Kashnikow
*Assistant Examiner*—Patrick N. Burkhart
*Attorney, Agent, or Firm*—Reising, Ethington, Barnard, Perry & Milton

[57] ABSTRACT

In the case of rotary atomizers, especially those having external electrodes on a grounded spray head, there is a danger of self-contamination of the front part of the atomizer housing; the latter is, therefore, provided with a rotating cover (10) which may be connected to the rotating spray head (2).

23 Claims, 2 Drawing Sheets

ATOMIZER FOR ELECTROSTATICALLY COATING OBJECTS

TECHNICAL FIELD

The subject invention relates to an atomizer for electrostatically coating objects, and particularly, atomizers that have a rotary spray head.

BACKGROUND ART

Known rotary atomizers, such as those used for electrostatically coating automobile bodies, are contaminated while in operation by the coating material which they spray. The parts particularly affected are the bell plate casing, the drive shaft area between the spray bell and the front housing part containing the mounting shaft and the external surfaces of the housing part itself. Not only does this unwanted deposit of coating material initially fail to reach the object to be coated, but some of it may also later break away while the unit is in operation and then reach the object, resulting in considerable contamination thereof, especially if there has been a color change in the meanwhile. Therefore, known atomizers must be cleaned frequently and regularly. This is a relatively tedious and time-consuming operation involving lengthy shut-downs which are particularly detrimental to mass production coating.

This self-contamination occurs not only in conventional rotary atomizers (cf. EP Patent No. 0032391), in which the electrostatic field which charges the paint particles is produced between the high voltage spray bell and the grounded body, but to a still greater degree, in apparatuses including a grounded spray head and external electrodes for producing the electrical field, in which there is no potential gradient between the spray head and the object to be coated to oppose the danger of contamination (cf. German OS No. 34 29 075). Apparatuses including external electrodes have the advantage of being suitable for paint materials which do not pollute the environment, contain few organic constituents and are relatively highly conductive. The self-contamination problem, however, in these apparatuses has hitherto substantially prevented the use of paint materials which are not harmful to the environment.

STATEMENT OF INVENTION AND ADVANTAGE

An atomizer for electrostatically coating objects including a spray head mounted rotatably in a housing (5) having external surfaces characterized by a rotating anti-particulate cover means (10) extending axially from the terminal front face of a base 20.

The purpose of the subject invention is to provide an atomizer, the external areas of which contain the drive and the mounting for the spray head, which is less likely to be contaminated by the coating material than prior art devices and which can be cleaned more easily if necessary. The rotating anti-particulate cover means, which may well be an extension of the bell plate or the like, beyond the front end of the housing may be substantially easier to clean than stationary housing surfaces, for example, by spraying the cover means with a solvent. Surprisingly, there is practically no self-contamination of the rotating parts (the cover and the spray head). This may be attributable to the airflow produced by the rotary motion.

FIGURES IN THE DRAWINGS

Other advantages of the present invention will be readily appreciated as the same becomes better understood by reference to the following detailed description when considered in connection with the accompanying drawings.

DETAILED DESCRIPTION OF THE DRAWINGS

An atomizing device including a rotary atomizer is particularly suitable for coating automobile bodies with so-called water enamels. The atomizing device includes spray head 2 having a bell plate 3 mounted upon a hollow shaft assembly 4 containing a paint supply line. The hollow shaft assembly 4 is located, in known fashion, in the front part 5 of the atomizer housing. While in operation, the spray head 2 is grounded while in operation and is at the same potential as the body or object to be coated.

Figure 2:
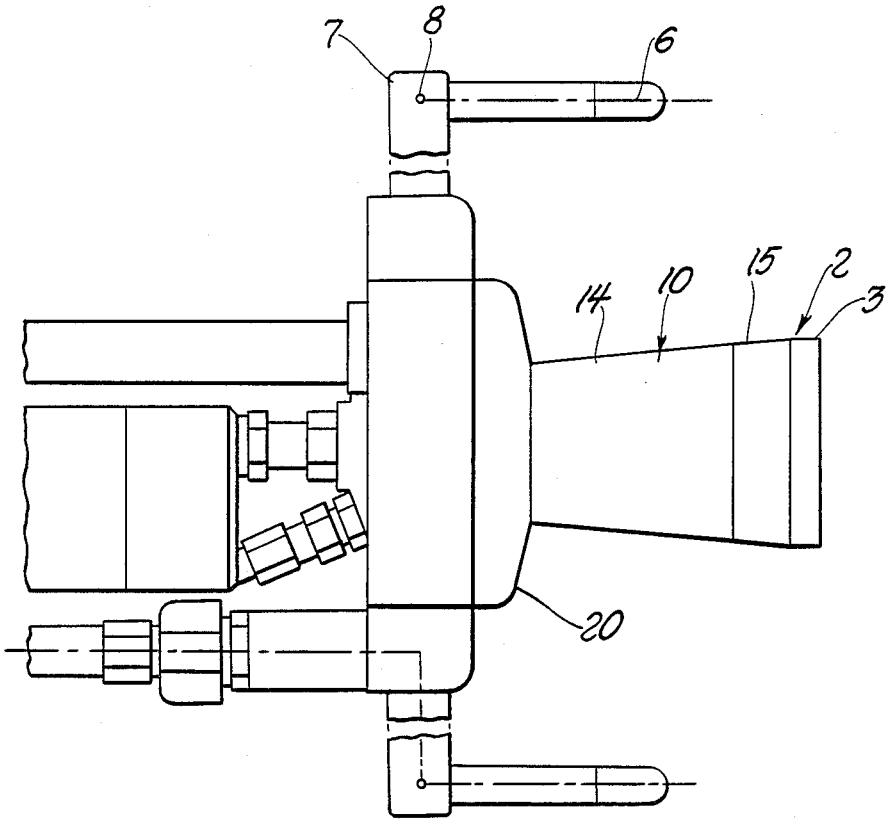
FIG. 2 is an elevational view of the subject invention on an electrostatic coating apparatus.

As illustrated in FIG. 2, the necessary electrostatic field is produced by a plurality of external electrodes 6. The rear ends of the external electrodes 6 are inserted into an annular element 7 which is made of an insulating material and surrounds the atomizer housing at a distance therefrom. The annular element 7 includes an electrical lead 8 within the annular element 7, and electrodes 6 together annularly. The electrical lead 8 is connected to a high voltage line and is insulated from the surface of the annular element 7 facing the body or object to be coated. The arrangement and spacing between the electrodes 6 results in no substantial deposit of coating material upon the front face of annular element 7 while the unit is in operation. The electrodes 6 are preferably disposed in finger-like projections which are made of an insulating material and extend from the front surface of annular element 7.

Figure 1:
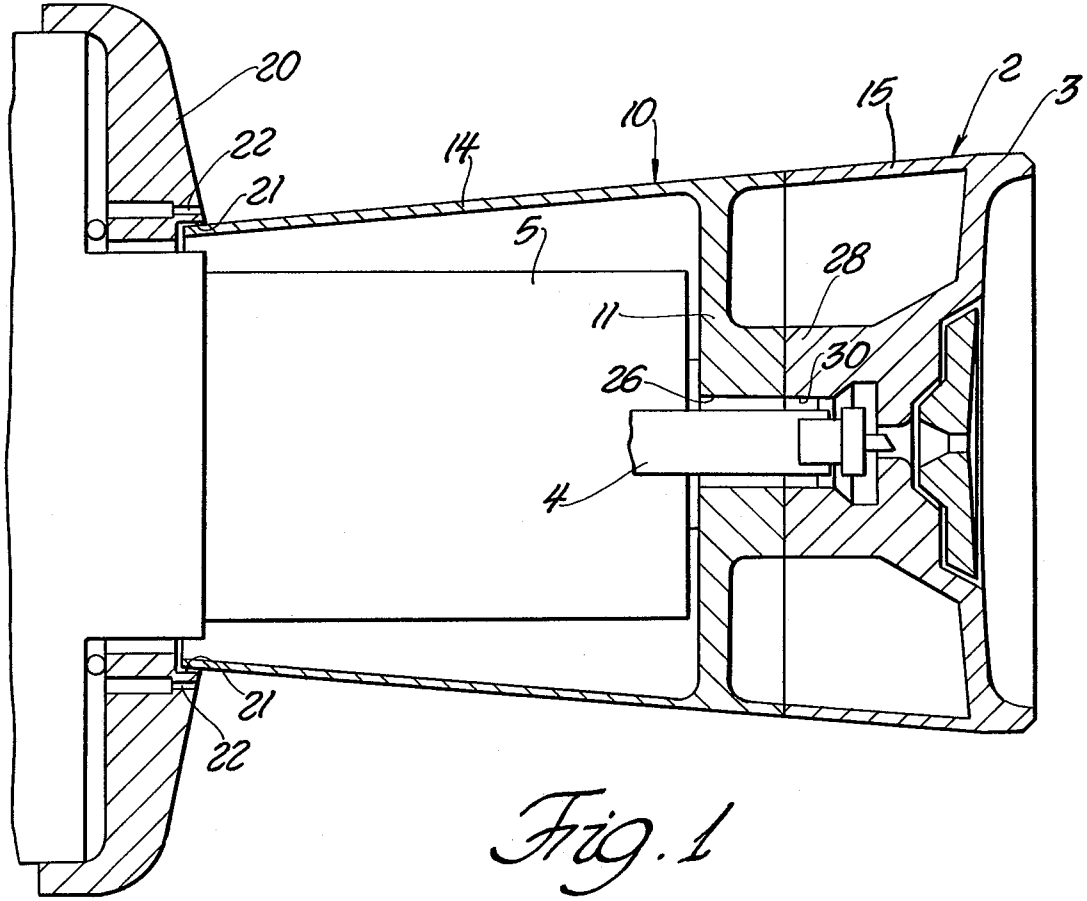
FIG. 1 is an elevational sectional view of the subject invention.

Instead of the annular electrode arrangement as shown in FIG. 1, which is described in greater detail in German Patent Application Ser. No. P 36 09 240.1, it would be possible to provide external electrodes distributed radially around the spray head, each having its own holder projecting from the housing, as known from German OS No. 34 29 075. However, the subject invention is also suitable for spraying units in which the spray head itself is at a high voltage potential.

The atomizer device includes a rotating anti-particulate cover means 10 which is provided for front part 5 of the atomizer housing. The external surface of the atomizer housing 5 including the front surface, is located in an area where there is a danger of contamination by the coating material sprayed from bell plate 3. The rotating anti-particulate cover means 10 is generally cup-shaped, as illustrated in FIGS. 1 and 2 and may be made of metal. Anti-particulate cover means 10 extends axially from the terminal front face of base 20 to the terminal end of the spray head 2 closest to the object to be painted. The cover means 10 is substantially circular in cross section and has a different cross-sectional area at the terminal end of the spray head 2 closest to the object to be painted than at the opposite end of the cover means 10 adjacent the terminal front face of the base 20. More particularly, the cover means 10 has a greater cross-sectional area at the terminal end of the spray head 2 than at the opposite end of the cover means 10 adjacent the terminal front face of the base 20. The anti-particulate cover means 10 rotates to agitate the surrounding ambient air and to create a layer of continuous adjacent air flow for preventing the contamination of the housing 5 and to the cover means 10 during electrostatic painting operations. The rotating cover 10 is seated with a central opening in the base coaxial with shaft assembly 4 and is prevented from rotating in relation thereto by means of two axial drive pins 12. The drive pins 12 in the cover 10 may be inserted simply, without any tools, into axial holes in a corresponding end face of shaft assembly 4.

Generally, the cover means 10 includes a housing cover portion 14 to enclose the cylindrical external surface of housing 5 concentrically and with a certain amount of play. The housing cover portion 14 extends to a base 20, the end face of which faces the spray head and contains an annular slot 21 in which the annular rear edge of sleeve-like cover part 14 engages rotatingly. This arrangement, forming a kind of labyrinth seal, prevents coating material from penetrating into the space between cover 10 and housing 5, especially when compressed air is introduced into slot 21.

As illustrated in FIG. 1, the cover means 10 also includes a bell cover portion 15 which is aligned gaplessly with the housing cover portion 14. The bell cover portion 15 forms the outer wall of the bell plate 3. Still better than a cylindrical cover having a radially constant outside diameter for preventing coating material from being deposited upon the cover means 10 is a cover in which the outside diameter of the cover decreases constantly towards the rear. This improvement is due to the corresponding changes in peripheral velocity. The conical expansion of the outside diameter continues forwardly on the external wall 15 of bell plate 3 into the vicinity of spraying edge 16.

Alternatively, the housing cover portion 14 may be integral with the bell cover portion 15. However, if the housing cover portion 14 and bell cover portion 15 are made as separate parts, they are substantially easier to mount upon the drive shaft than if they are in one piece (because the shaft may be held by the cover while the bell plate is being screwed on). The housing cover portion 14 includes an internal annular webbing 11 and an internal shaft bore 26 for receiving a drive shaft assembly 4. The bell plate 3 includes an internal webbing 28 and a drive shaft receiving board 30 for receiving the drive shaft 4, the annular webbing 11 of the housing portion 14 and the internal webbing 28 of the bell plate 3 being operatively connected together. The housing portion 14 is secured to the bell cover portion 15 of the bell plate 3 like a nut by means of a thread to the shaft assembly 4.

The base 20 includes outlet apertures 22 which are open radially outwardly but in the vicinity of the external surface of cover means 10. Air may emerge from these apertures 22 and may serve, on the one hand, as a guide in supporting and forming spray jets moving towards the object to be coated. On the other hand, this air may contribute to, or may even be necessary for, supporting and stabilizing the airflow, preventing contamination and those around rotating cover means 10. It may also be desirable for at least one outlet aperture 22 for a liquid or gaseous agent for cleaning cover means 10 to open out at the rear end thereof. This may be one of the above-mentioned air outlet apertures 22 or may be a separate aperture 23. Moreover, a separate cleaning device (not shown) may be arranged to move along the outer surface of cover means 10 for the purpose of cleaning it.

Under certain circumstances, it may be unnecessary for the housing cover portion 14 to rotate at the same relatively high speed as the bell cover portion 15. In such cases, the design, as described above, may be replaced by a cover portion 14 which is mounted rotatably and driven separately from the bell cover portion 15. For example, air nozzles arranged at the rear end of the housing cover portion 15 enclosing housing 5 could be used to drive the rotating cover portion 14.

If the rotating cover 10 means is connected to the spray head, the rotating cover means 10 applies a somewhat heavier load. This may require special cooling of the bearings, preferably with compressed air. The axial length of the rotating cover portion 14 or possibly that of the whole arrangement consisting of the rotating cover portion 14 and bell cover portion 15 should generally be at least equal to the diameter of the spray head 2.

The invention has been described in an illustrative manner and it is to be understood that the terminology which has been used in intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An atomizer for electrostatically coating objects with a sprayed coating material comprising; a housing (5) including external surfaces, a drive shaft assembly (4) operatively mounted within said housing (5); a spray head (2) mounted on said drive shaft assembly (4) rotatably in said housing (5), said spray head (2) and the object to be coated being at the same electrical potential when said unit is in operation, and characterized by a rotating housing cover (14) disposed about said housing (5) to prevent contamination of the external surfaces of said housing part located in an area where there is a danger of contamination by the sprayed coating material, the outside diameter of said housing cover portion becoming constantly smaller in the direction facing away from the object to be coated.

2. An atomizer as set forth in claim 1 further characterized by said cover housing portion (14) being secured firmly to the spray head (2).

3. An atomizer as set forth in claim 1 further characterized by including a bell plate (3) disposed about said spray head (2), said housing cover portion (14) being a component separate from the bell plate (3) of the spray head (2).

4. An atomizer as set forth in claim 3 further characterized by including drive pins (12) and a drive shaft assembly (4), said cover portion (14) secured by said drive pins (12) against rotation in relation to said drive shaft assembly (4).

5. An atomizer as set forth in claim 3 further characterized by the external surfaces of said cover portion (14) and said spray head (2) running constantly with each other.

6. An atomizer as set forth in claim 5 further characterized by said bell plate (3) of said spray head (2) including a bell cover portion (15) having an external surface, said external surface of said bell cover portion (15) having a diameter increasing conically towards the object to be coated, and which adjoins gaplessly the external surface of the housing cover portion (14).

7. An atomizer as set forth in claim 1 further characterized by said housing cover portion (14) including an annular end and being rotatable in relation to said spray head (2).

8. An atomizer as set forth in claim 7 further characterized by including at least one air inlet aperture (22) open out at the end of the cover portion (14) remote from the object to be coated.

9. An atomizer as set forth in claim 8 further characterized by at least one outlet aperture (23) for a liquid or gaseous cleaning agent opening out at the end of the cover (10) remote from the object to be coated.

10. An atomizer as set foth in claim 1 further characterized by said housing (5) including an annular recess (21), the annular end of the cover portion (14) being remote from the object to be coated and enclosing the housing (5), the annular end being mounted within and rotatable relative to an annular recess (21) in the housing (5).

11. An atomizer as set forth in claim 10 further characterized by including compressed air means for introducing compressed air into said annular recess (12).

12. An atomizer as set forth in claim 11 further characterized by including bearings of said rotating housing cover portion (14) and of said spray head being cooled by compressed air.

13. An atomizer as set forth in claim 12 further characterized by said cover portion (14) having a predetermined axial length and said spray head (2) having a predetermined diameter, the axial length of said cover portion (14) being at least equal to the diameter of said spray head (2).

14. An atomizer as set forth in claim 13 further characterized by the spray (12) having a predetermined axial length, the combined axial length of said cover portion (14) and spray head (2) being at least equal to the diameter of the spray head (2).

15. An atomizer for electrostatically coating objects including a housing (5) and a spray head (2) having a periphery and rotatably mounted to said housing (5), said housing (5) terminating at a base (20) having a front face; rotating anti-particulate cover means (10) extending axially from the terminal front face of said base (20) to the periphery of said spray head (2) closest to the object to be painted, said anti-particulate cover means (10) rotating to agitate the surrounding ambient air and to create a layer of continuous adjacent air flow for preventing the contamination of said housing (50) and said cover means (10) during electrostatic coating operations, said anti-particulate cover means (10) being substantially circular in cross section and having a greater outer cross-sectional diameter at the periphery of said spray head (2) closest to the object to be painted than at the opposite end of said cover means (10) adjacent the terminal front face of said base (20).

16. An atomizer as set forth in claim 15 further characterized by said anti-particulate cover means (10) including a housing cover portion (14) and a bell cover portion (15) fixedly secured together such that said housing cover portion (14) and said bell cover portion (15) rotate together.

17. An atomizer as set forth in claim 16 further characterized by said atomizer including a bell plate (3), said bell cover portion (15) forming the outer wall of said bell plate (3).

18. An atomizer as set foth in claim 15 further characterized by said antiparticulate cover means (10) including a housing cover portion (14) and bell cover portion (15) rotatable in relation to each other.

19. An atomizer as set forth in claim 18 further characterized by said base (20) including an annular recess (21) in the front face of said base (20).

20. An atomizer as set forth in claim 19 further characterized by means for introducing compressed air into said annular reces (21).

21. An atomizer as set forth in claim 20 further characterized by the axial length of said housing cover portion (14) being at least equal to the diameter of said spray head (29).

22. An atomizer as set forth in claim 21 further characterized by the axial length of said housing cover portion (14) and said bell cover portion (15) together being at least equal to the diameter of said spray head (2).

23. An atomizer for electrostatically coating objects including a housing (5) and a spray head (2) having a periphery and rotatably mounted to said housing (5), said housing (5) terminating at a base (20) having a front face; rotating anti-particulate cover means (10) extending axially from the terminal front face of said base (20) to the periphery of said spray head (2) closest to the object to be painted, said anti-particulate cover means (10) rotating to agitate the surrounding ambient air and to create a layer of continuous adjacent air flow for preventing the contamination of said housing (5) and said cover means (10) during electrostatic coating operations, said anti-particulate cover means (10) being substantially circular in cross section and having a greater outer cross-sectional diameter at the periphery of said spray head (2) closest to the object to be painted than at the opposite end of said cover means (10) adjacent the terminal front face of said base (20), said anti-particulate cover means (10) including a housing cover portion (14) and a bell cover portion (15) fixedly secured together such that said housing cover portion (14) and said bell cover portion (15) rotate together, said atomizer including a bell plate (3), said bell cover portion (15) forming the outer wall of said bell plate (3), said housing cover portion (14) including an internal annular webbing (11) and an internal shaft bore (26) for receiving a drive shaft assembly (4); said bell plate (3) including an internal webbing (28) and a drive shaft receiving bore (30) for receiving the drive shaft (4), said annular webbing (11) of said housing cover portion (14) and said internal webbing (28) of said bell plate (3) being operatively connected together.

* * * * *